United States Patent [19]

Bloch et al.

[11] Patent Number: 5,000,661

[45] Date of Patent: Mar. 19, 1991

[54] METHOD OF AND APPARATUS FOR CLEANING AND FILLING CONTAINERS

[75] Inventors: Manfred Bloch, Berlin; Manfred Gutapel, Bielefeld; Manfred Schepper, Herford; Wolfgang Stein, Minden, all of Fed. Rep. of Germany

[73] Assignee: Leifeld & Lemke Maschinenfabrik GmbH & Co. KG, Hiddenhausen, Fed. Rep. of Germany

[21] Appl. No.: 416,550

[22] Filed: Oct. 3, 1989

[30] Foreign Application Priority Data

Oct. 5, 1988 [DE] Fed. Rep. of Germany ..... 3833885

[51] Int. Cl.[5] ..... B67C 1/047; B65B 3/04

[52] U.S. Cl. ..... 141/1; 141/113; 141/168; 141/89; 141/270

[58] Field of Search ..... 141/1, 113, 129, 165, 141/168, 170, 171, 172, 176, 250, 267, 268, 269, 270, 271, 279, 281, 283, 284, 248, 89–97, 91

[56] References Cited

U.S. PATENT DOCUMENTS

| | | | |
|---|---|---|---|
| 3,831,675 | 8/1974 | Golding et al. | 141/171 X |
| 3,977,154 | 8/1976 | Kamisaka et al. | 141/171 X |
| 4,628,972 | 12/1986 | LaRochelle | 141/91 |
| 4,804,024 | 2/1989 | Annemann | 141/165 |

FOREIGN PATENT DOCUMENTS

| | | | |
|---|---|---|---|
| 1557580 | 4/1970 | Fed. Rep. of Germany . | |
| 2710961 | 9/1978 | Fed. Rep. of Germany | 141/172 |
| 1951785 | 10/1979 | Fed. Rep. of Germany | 141/171 |
| 1558056 | 1/1969 | France . | |

*Primary Examiner*—Ernest G. Cusick

*Attorney, Agent, or Firm*—Chilton, Alix & Van Kirk

[57] ABSTRACT

Containers such as beer kegs are cleaned and filled by movement along a linear treatment line, in step-wise fashion, and delivery to movable filling stations which are alternately brought into alignment with the treatment line. The filling procedure is accomplished continuously while the containers are moving, the filling station motion having a directional component which is angularly related to the axis of the treatment line, away from and back to the position of alignment with the treatment line.

9 Claims, 1 Drawing Sheet

METHOD OF AND APPARATUS FOR CLEANING AND FILLING CONTAINERS

BACKGROUND OF THE INVENTION

1. Field of the Invention

The present invention relates to the cleaning and filling of containers and particularly to the handling of barrels and kegs pursuant to the sterilization and refilling thereof. More specifically, this invention is directed to apparatus for cleaning and subsequently filling containers, especially containers which have a valve fitting which projects inwardly, wherein the containers are subjected to a series of treatments prior to filling. Accordingly, the general objects of the present invention are to provide novel and improved methods and apparatus of such character.

2. Description of the Prior Art

While not limited thereto in its utility, the present invention is particularly useful in the cleaning and filling, in a series of steps which are performed serially and continuously, of cylindrical barrels such as, for example, beer kegs. Such kegs, of course, are provided with a barrel valve fitting that projects inwardly. During cleaning and filling, the valve-controlled supply and drain lines for the treatment media and the media with which the containers are to be filled are coupled to the interior of the container via the barrel valve fitting through the use of coupling-head assemblies. In the prior art, the throughput capacity of a barrel cleaning and filling facility has been limited by the filling operation. That is, the rate at which a cleaned barrel can be filled is limited by the barrel valve fitting cross-section and the filling step thus takes substantially more time than that required at the upstream treatment stations.

Published German patent application 1,557,580 discloses a prior barrel cleaning and filling facility in which barrels are cleaned, sterilized and filled with beer at stations which are arranged in series, the filling being effected isobarometrically. In this prior art facility, a barrel to be cleaned and filled, with the barrel valve fitting downwardly oriented, is forwarded from station to station, in a stepwise manner, by means of oscillating transport arms. The prior art facility also includes supporting beams for the barrels. At each individual station, a barrel to be treated or filled is coupled to a spring-loaded, coupling-head assembly through the use of clamping means which acts on the barrel from above. The coupling-head assembly and clamping means automatically actuate the valves through which communication to the inside of the barrel is established. Thus, in the apparatus of German application 1,557,580, the barrels pass, one after another, through the facility beginning with a cleaning station in which cleaning fluid is injected followed by the injection of hot water. Subsequent to the cleaning station, the barrel is transferred to a steaming station in which it is sterilized. Subsequent to sterilization, a barrel is transferred to a treatment station in which it is charged with $CO_2$ at the counter-pressure required for the isobarometric filling operation. Finally, the barrel is transferred to a filling station, located immediately downstream of the $CO_2$ charging station, where it is filled with beer.

In a facility of the type disclosed in German application 1,557,580, which comprises treatment stations and a filling station which are arranged linearly, the throughput rate of the facility is, as noted above, determined by the filling step. Typically, the filling station has a throughput which is about one-half that which can be achieved by the upstream stations.

In the interest of increasing throughput, published German application 1,557,580 further suggests a multiple arrangement of individual treatment stations and the use of filling means in the form of a circular filler or, alternatively, the employment of a plurality of filling means which can be connected to the cleaning facility in an in-line arrangement whereby the barrels can be conveyed to the individual filling stations by means of transport devices. While the arrangements suggested by the published application theoretically permit increased throughput, they have the disadvantages of requiring considerable floor space and of being relatively expensive to implement.

SUMMARY OF THE INVENTION

The present invention overcomes the above briefly discussed and other deficiencies and disadvantages of the prior art by providing a novel technique for use in the cleaning and filling of containers, especially barrels or kegs which have a barrel valve fitting, and novel apparatus for use in the practice of such technique. Apparatus in accordance with the present invention, when employed in the processing of beer kegs, treats the beer gently while simultaneously enabling a twofold increase in throughput to be achieved when compared to conventional prior art in-line facilities. Apparatus in accordance with the present invention is also characterized by a requirement for approximately the same amount of floor space as prior art apparatus employed for the same purpose and the present apparatus can be fabricated and installed at modest cost.

In accordance with the present invention, a container cleaning and filling facility is provided with two filling stations which may be moved in synchronism with the stepwise transport of the containers from station-to-station along a linear array of treatment stations. The filling stations are alternately moved from a common position in alignment with the array of treatment stations, where a filled container is delivered to a removal conveyor and an empty container thereafter accepted, to a lateral or displaced position. Thus, one filling station moves, once per cycle, to a left lateral position and back to the aligned position while the other filling station moves, once per cycle, to a right lateral position and back to the aligned position. The supply and discharge lines for the media are controlled in synchronism with the movement of the filling stations such that, after a container has been accepted by a filling station and coupled to a coupling-head assembly, that container is filled during the movement from the aligned or acceptance position to the lateral position and back to the aligned position, the filling preferably beginning immediately after the coupling has been established. No interruption in the filling flow occurs during the movement of the filling station away from and back to the aligned position.

In accordance with a preferred embodiment, the supply and drain lines for the media are controlled in synchronism with the movement of the filling stations in a manner such that the containers are filled, one after another, during lateral movement. This mode of control results in a doubling of throughput when compared to a conventional prior art in-line cleaning and filling facility. As a consequence of the continuous operation of the filling-head assemblies, there is no interruption in the filling flow in the practice of the present invention and, accordingly, a continuous flow may be maintained in the lines with the result that optimum pressure matching and gentle treatment of the media with which the container is filled is achieved.

BRIEF DESCRIPTION OF THE DRAWING

The present invention may be better understood and its numerous objects and advantages will become apparent to those skilled in the art by reference to the accompanying drawing wherein like reference numerals refer to like elements in the two figures and in which.

DESCRIPTION OF THE DISCLOSED EMBODIMENT

Figure 1:
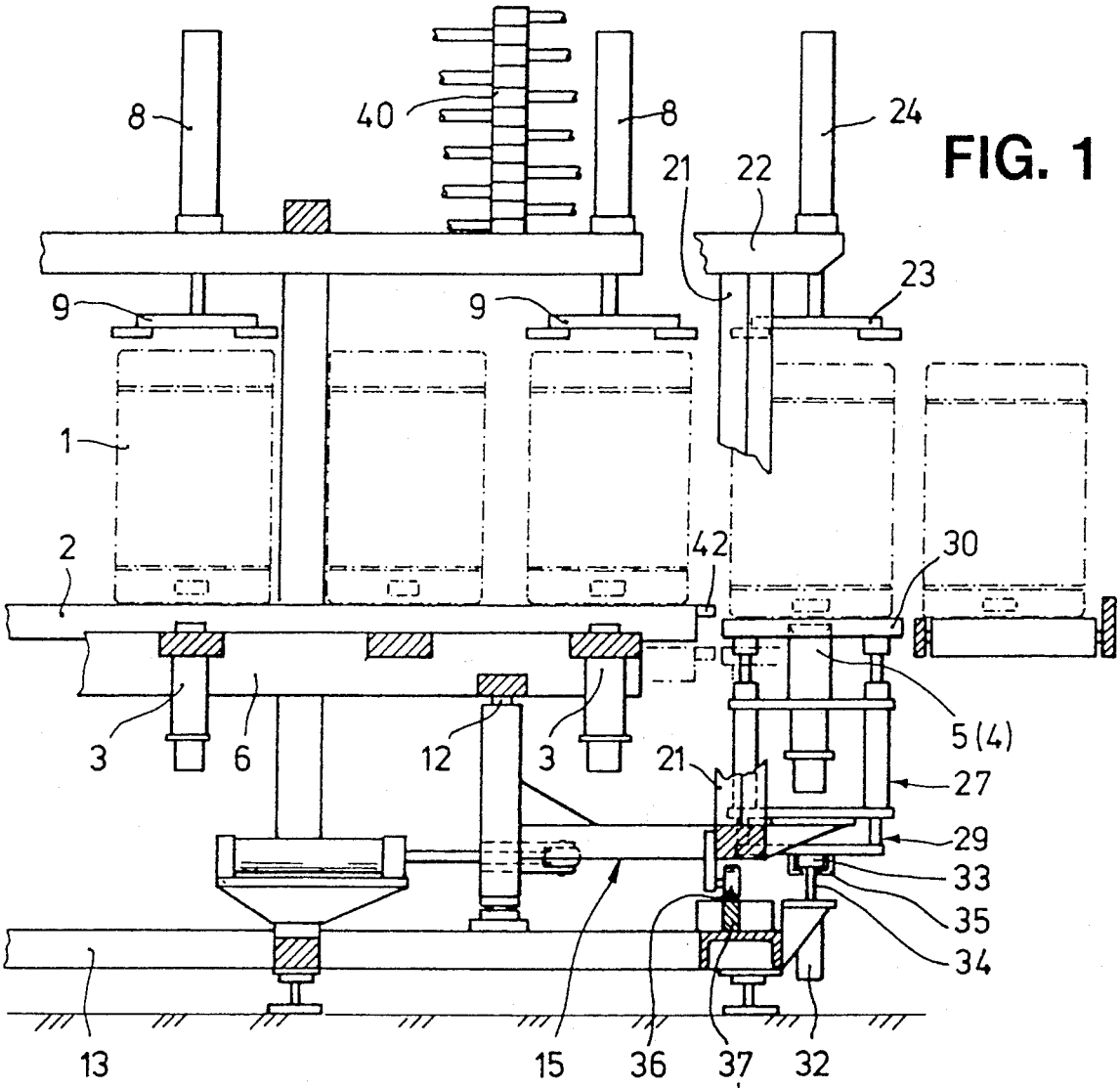
FIG. 1 is a schematic side-elevation view of apparatus in accordance with a first embodiment of the invention.

Referring now to the drawings, the disclosed embodiment of the invention is designed for use in the processing of cylindrical containers 1. The containers 1 may, for example, be kegs having a barrel valve fitting which remains in the bottom of the keg. As is well known, such fittings incorporate a riser tube which projects into the barrel, as well as check valves for the through-openings. The barrel valve fittings serve as the means by which the barrel is connected to supply and drain lines for cleaning media and for the beer or other fluid which is to be ultimately dispensed from the keg.

The disclosed embodiment comprises a treatment sub-assembly consisting of a plurality of treatment stations which are arranged in a row. Each treatment station includes a coupling-head assembly 3. The apparatus further comprises a filling sub-assembly which defines a pair of filling stations which are indicated at 10 and 11. The filling stations are respectively provided with coupling-head assemblies 4 and 5 only station 5 being visible in FIG. 1. A walking-beam type conveyor 2 transports the kegs 1 from station-to-station. In the manner known in the art, valve controlled supply and drain lines for treatment media and the media with which the barrels are to be filled are connected to the appropriate coupling-head assemblies. These drain and supply lines have been omitted from the drawing in the interest of facilitating understanding of the invention.

The kegs 1 are supported, on a pair of parallel beams 6, and are moved from station-to-station in a stepwise manner by the walking-beam conveyor 2. During transport, the kegs describe an upward movement and a forward and downward movement, the walking-beam conveyor subsequently transcribing a return movement to its starting position.

A clamping plate assembly 9 is mounted in registration with each of the coupling-head assemblies 3. The clamping plate assemblies 9 are operated by fluidic actuators 8. When actuated, the clamping plates press the kegs downwardly against the coupling-head assemblies to establish coupling and to hold the kegs in the coupled position. Such opposed-action holding means are also provided, as will be described below, at the two filling stations 10, 11.

The sub-assembly comprising the filling stations 10, 11 is located immediately adjacent to an end of the linear array of treatment stations which define the treatment sub-assembly of the apparatus. The filling station sub-assembly is mechanically connected to the remainder of the apparatus and is operated in synchronization therewith. Within the filling station sub-assembly, the individual stations 10, 11 are mounted on a slewing frame 15 so as to be separated by a defined lateral distance. The slewing frame 15 is moveable about a vertical axis 12 which forms part of the frame 13 of the cleaning/filling apparatus, the axis 12 being located along the axis of the linear array of treatment stations. Movement of slewing frame 15 causes the two filling stations 10, 11 to be slewed so that one is displaced to a left lateral position once per cycle while the other is displaced to a right lateral position once per cycle, such left and right movement being in alternation.

The slewing frame 15 comprises a pair of cantilever booms or arms 18, 19, a bridge 20 and a supporting frame 21 which is mounted on bridge 20. Movements are imparted to frame 15 by means of the working cylinder 16 of a fluidic actuator via a lever 17. The supporting frame 21 extends vertically from bridge 20 and carries upper transverse arms 22 which extend over the filling stations. The arms 22 support the opposed-action holding means for kegs which are located at the filling stations. These holding means comprise clamping plates 23 which cooperate with the oppositely directed coupling-head assemblies 4, 5. Movements are imparted to the clamping plates 23 by means of fluidic actuators 24.

The coupling-head assemblies 4 and 5, respectively of filling stations 10 and 11, are each mounted on a structural assembly which has been indicated generally at 27 in FIG. 1 for assembly 5. The structural assembly 27 is permanently affixed to the slewing frame 15 and comprises a lifting frame 29 which carries a bearer beam 30. The frame 29, and thus the beam 30, can be moved between upper and lower limits of travel by means of a fluidic actuator which comprises a working cylinder 32 mounted on the machine frame 13. The lifting frames thus function to establish the coupling and uncoupling of the head assemblies 4, 5 at the filling stations. After filling and uncoupling, a keg is pushed clear of the beam 30 when the filling station is in its aligned, accepting and delivery position.

Figure 2:
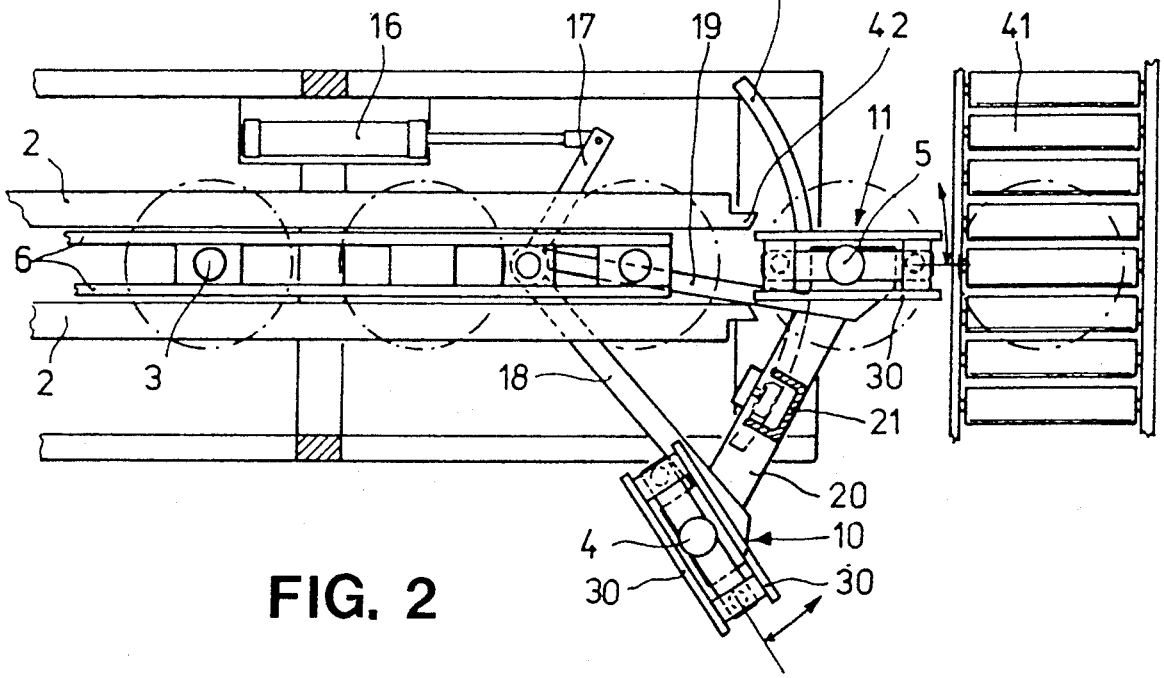
FIG. 2 is a top plan view of the apparatus of FIG. 1, the upper clamping components of the FIG. 1 apparatus having been eliminated from FIG. 2 in the interest of clarity.

During the slewing movement of the frame 15, a follower roller 33 at the end of a piston rod 34 of the cylinder 32 travels in a guide track 35 on frame 29. As best seen from FIG. 2, the beams 30 associated with each of the filling stations 10, 11 are oriented parallelly with the supporting beams 6 when a filling station is in the position in which the kegs are delivered thereto.

The slewing frame 15 is also provided with a guide roller 36 which travels along a track 37 as the frame 15 slews. The track 37 is affixed to the machine frame 13.

The actuator 16 which causes the slewing movement of frame 15 moves the filling stations 10, 11 to the left and right lateral positions and back to the aligned position (see filling station 11 in FIG. 2) in synchronism with the stepwise transport of the kegs 1. At the same time, the media supply and drain lines associated with the coupling head assemblies are controlled by a rotary distributor 40 and valves and connecting lines which are not shown. The supply connecting lines may, for example, include hoses coupled to a fixed beer supply system. The control of the supply and drain lines is effected in synchronism with the slewing movements of the filling stations 10, 11 such that, whenever the walking-beam conveyor 2 has placed a keg 1 on the bearer beams 30 of a filling station and coupling has been completed as a consequence of the operation of a clamping plate 23, the filling operation is performed during the slewing movement from the keg accepting position to the displaced lateral position and back to the accepting or aligned position. When one of the filling stations has been slewed to its maximum lateral position, the other filling station will be in position to receive the next keg to be filled. The walking beam conveyor, by means of its front pusher elements 42, will push a filled barrel standing on the bearer beams 30 of a filling station longitudinally onto a delivery-side conveyor device 41 which is located adjacent the filling sub-assembly of the apparatus.

As should be obvious from the above discussion, the operation of filling a keg begins with the backward movement of the keg from the lateral position into the acceptance or delivery position. The filling head assemblies remain in continuous operation and, consequently, there is no interruption in the filling flow. The control of the supply and drain lines for the media is preferably effected in a manner such that the filling operation begins immediately after the keg has been coupled to a coupling-head assembly 4, 5.

In a modified arrangement, the two filling stations can be displaced to the right and left along straight paths which are oriented transversely with respect to the axis of the treatment sub-assembly.

It is particularly to be noted that the supply and drain lines for the media can be controlled in synchronism with the movement of the filling stations such that the kegs or barrels are filled, one after another, during the movement to the displaced positions. This, for example, is a technique which may be utilized for filling small-volume barrels.

While a preferred embodiment has been shown and described, various modifications and substitutions may be made thereto without departing from the spirit and scope of the invention. Accordingly, the present invention has been described by way of illustration and not limitation.

What is claimed is:

1. In apparatus for cleaning and filling containers, the apparatus comprising a plurality of treatment stations linearly arranged in series, said serially arranged treatment stations cooperating to form a treatment subassembly which defines a line, fluidic coupling-head assemblies being located at the individual stations of the treatment subassembly, valve-controlled supply and drain conduits for the treatment media being connected to the coupling-head assemblies, the apparatus further comprising holding means for clamping the containers to the coupling-head assemblies and a transport device for moving the individual containers from station to station in a stepwise manner, the improvement comprising two movable filling stations for receiving and supporting individual containers to be filled, each of said filling stations including a coupling head and means for clamping a container to the coupling head whereby fluid communication may be established between a source of the media with which the containers are to be filled and the interior of a container which has been received at a filling station, means for imparting movement to both of said filling stations in synchronism with the stepwise movement of the containers, said movement imparting means displacing said filling stations alternately from a container receiving position which is located in alignment with the treatment subassembly defined line to respective first and second displaced positions and thereafter alternately returning the displaced filling stations to the container receiving position, valve-controlled supply conduit means for the media with which the containers are to be filled connected to the coupling head associated with each filling station, the supply conduit means for the media with which the containers are to be filled being controlled in synchronism with the movement of the filling stations, a container which has been received at a filling station and coupled to the associated coupling head being filled during the subsequent displacement of the filling station from the receiving position to the displaced position and back to the receiving position without interruption in the filling flow, and means for ejecting filled containers from said filling stations, a filled container being ejected and a treated empty container being received at one filling station while the other filling station is located at its displaced position and the container supported thereon is being filled.

2. The apparatus of claim 1 wherein said filling stations are mounted on a common supporting member and wherein said filling station motion imparting means comprises operating means for displacing each filling station from a position in alignment with the treatment subassembly defined line respectively to the first and second displaced positions in alternation and in synchronism with the stepwise container motion produced by the transport device, each filling station clamping means comprising an opposed-action holding means, each filling station comprising load-bearing elements for a container, said holding means, coupling head and load-bearing elements of each filling station being vertically movable relative on to another, the filling stations being located one stepwise travel-internal distant from the last treatment station of the treatment subassembly when in the container receiving position.

3. The apparatus of claim 2 wherein said supporting member is a slewing frame which can be slewed about an axis aligned with the treatment subassembly defined line, said motion imparting means including a fluidic actuator which produces said slewing movement.

4. The apparatus of claim 3 wherein each of said filling station coupling-heads is permanently located on a structural component carried by said slewing frame, and wherein each of said filling stations further comprises a lifting frame for lifting said load-bearing elements, said lifting frame being freely slidable in said supporting member, each of said filling heads further comprising an actuator for causing said lifting frame to be moved between upper and lower travel limits.

5. The apparatus of claim 1 wherein said media supply conduit means includes a rotary distributor.

6. The apparatus of claim 2 wherein said media supply conduit means includes a rotary distributor.

7. The apparatus of claim 3 wherein said media supply conduit means includes a rotary distributor.

8. The apparatus of claim 4 wherein said media supply conduit means includes a rotary distributor.

9. A method for the processing of containers, the containers having normally enclosed integral valve assembly through which communication to the interior thereof may be established, said method comprising the steps of:

moving a first container to a first treatment station and coupling a source of treatment media to the interior of the first container via the integral valve assembly whereby a first treatment step may be performed;

moving the first container along a linear path and in step-wise fashion to at least a second treatment station and coupling a source of treatment media to the interior of the first container via the integral valve assembly whereby a second treatment step may be performed;

moving the first container along the linear path and in step-wise fashion to a receiving position and placing the container on a first movable filing station at the receiving position;

coupling a source of a media with which the containers are to be filled to the interior of the first container via the integral valve assembly while the first filling station is at the receiving position;

instituting flow of the media with which the first container is to be filled and imparting movement to the first filling station and the first container to a first displaced position and subsequently back to the receiving position, the direction of movement toward and away from the receiving position including a component of motion which has an angular relationship to the said linear path;

moving a second container along the linear path in step-wise fashion to the receiving position, the first and second treatment steps being performed on the second container during such movement, and placing the second container on a second movable filling station, the second container reaching the receiving position when the first container is at said first displaced position of the first filing station;

coupling the source of media with which the containers are to be filled to the interior of the second container via its integral valve assembly while the second filing station is at the receiving position; and instituting flow of the media with which the second container is to be filled and imparting movement to the second filling station and second container to a second displaced position and subsequently back to the receiving position, the direction of movement of the second filling station to and from the receiving position including a component of motion which is angularly related to the said linear path, and the direction of motion of the first filling station the movements of the first and second filling stations being alternated.

* * * * *